US007575522B1

(12) United States Patent
Affrunti

(10) Patent No.: US 7,575,522 B1
(45) Date of Patent: Aug. 18, 2009

(54) GOLF SETUP TRAINING DEVICE

(76) Inventor: Joseph A. Affrunti, 330 Douglas Ave., Crystal Lake, IL (US) 60014

( * ) Notice: Subject to any disclaimer, the term of this patent is extended or adjusted under 35 U.S.C. 154(b) by 8 days.

(21) Appl. No.: 11/906,505

(22) Filed: Oct. 2, 2007

(51) Int. Cl.
*A63B 69/36* (2006.01)

(52) U.S. Cl. ..... 473/273; 473/270; 473/272

(58) Field of Classification Search ..... 473/218, 473/257, 261, 266, 268, 270, 272, 273
See application file for complete search history.

(56) References Cited

U.S. PATENT DOCUMENTS

| | | | | | |
|---|---|---|---|---|---|
| 1,922,130 | A | * | 8/1933 | Haserodt | 33/508 |
| 2,180,170 | A | | 11/1939 | Richards | |
| 2,777,697 | A | | 1/1957 | Crossot | |
| 3,459,429 | A | * | 8/1969 | Green | 473/218 |
| 3,708,174 | A | * | 1/1973 | Kamarauskas | 473/273 |
| D244,791 | S | * | 6/1977 | Sullivan, Jr. | D21/791 |
| 4,384,718 | A | | 5/1983 | Cachola | |
| 4,563,010 | A | | 1/1986 | McDorman et al. | |
| 4,647,048 | A | | 3/1987 | Welch | |
| 5,203,453 | A | * | 4/1993 | Dirito | 206/315.3 |
| 5,322,288 | A | | 6/1994 | Amis | |
| 5,362,060 | A | | 11/1994 | Hinson | |
| 5,482,284 | A | | 1/1996 | Vandever | |
| 5,951,409 | A | * | 9/1999 | Calley | 473/218 |
| 6,440,004 | B1 | * | 8/2002 | Rodriguez | 473/218 |
| 6,752,724 | B1 | | 6/2004 | Schumacher | |

* cited by examiner

*Primary Examiner*—Nini Legesse
(74) *Attorney, Agent, or Firm*—Lloyd L. Zickert

(57) ABSTRACT

A golf setup training device for training a golfer to take the best possible setup in relation to a ball when addressing the ball prior to hitting the ball. The device includes a pair of axially aligned foot-positioning bars and extending therefrom at right angles a ball-positioning bar that includes a fixed section and an extendable section. The extendable section is adjustably mounted to the fixed section to adjust the length of the ball-positioning bar according to the height of the golfer and/or for a chosen iron. The device may be easily partially disassembled for compact storage.

11 Claims, 4 Drawing Sheets

GOLF SETUP TRAINING DEVICE

This invention relates in general to a golf setup training device for training a golfer to have the best possible setup or stance for swinging at a ball depending on the height of the golfer, and more particularly to a golf setup training device including foot-alignment means and ball-placement means for setting the ball at a proper position for swinging at the ball with a given club.

BACKGROUND OF THE INVENTION

Heretofore, it has been well known to provide golf training devices for adjusting the stance of a person in addressing the ball before making contact between the club head and the ball during swinging of the club. For example, U.S. Pat. No. 4,563,010 discloses a rather complex training device having several adjustable members to assist a golfer in determining the correct stance to take before swinging at a ball. Additional stance devices are disclosed in U.S. Pat. Nos. 2,180,170; 2,777,697; 4,384,718; 4,647,048; 5,322,288; 5,362,060; 5,482,284; and 6,752,724.

It is well known that the posture, balance and stance of a golfer have a direct bearing on the ability of the golfer to swing properly and make the best contact with the golf ball. Indeed, it is important that substantially the center of the club face strikes substantially the center of the ball to produce the best possible results for a shot. The alignment of the feet is significant for directional control of the ball flight, and the distance the ball is placed from the feet is significant to provide the proper posture for striking the ball and promote the most efficient swing. Accordingly, a training device for accomplishing these skills so that the proper setup is made will significantly assist the golfer in producing the best possible shot, as well as the best possible swing.

The distance a ball is placed from the feet of a golfer that takes the proper posture depends upon and is directly related to the height of the golfer and the club chosen for striking the ball. For example, a golfer 5 feet 7 inches in height when using a 6 iron would position the ball 22 inches from the feet, while a taller golfer would position the ball closer to the feet, and a shorter golfer would position the ball farther from the feet. Also, the feet-to-ball distance would be related to the particular club chosen. The lower numbered club would require placement of the ball farthest from the feet, while the higher numbered club would require placement of the ball much closer to the feet. The present invention includes the feature of setting the placement of the ball from the feet of the user, along with the alignment of the body for ball flight direction.

SUMMARY OF THE INVENTION

The golf setup training device of the present invention is not only simple in structure to enable the golfer to easily adjust the device for the golfer's stance depending on the golfer's height and the club chosen for a practice session. It is simply constructed with a minimum number of parts to be easily adjusted for use, and disassembled for compact storage in the golfer's golf bag. The device of the invention includes a pair of foot-aligning bars and a ball-positioning bar extending from the foot-aligning bars that is adjustable depending on the height of the golfer and the club selected for a particular training exercise. The device of the invention is particularly suited for use with irons such as the irons 2 to 9, the pitching wedge, the sand wedge, the gap wedge, and the lob wedge. It should be appreciated that it could be made for use with other clubs.

As above noted, the adjustable ball-positioning bar is adjustable not only for the height of the golfer but also for the particular club chosen for a practice exercise. Graduations relating to a golfer's height are provided on the extendable section of the ball-positioning bar that coact with the end of the fixed section to enable the proper extension of the extendable section for the golfer. The graduations are preferably labeled for adjusting the bar by one-quarter inch increments, and height values, but may be labeled in any suitable manner.

A twist connector or other suitable device is provided on the fixed section to coact with and selectively lock the adjustable section to the fixed section at a predetermined location during use of the device. The extendable section is telescopically received by the fixed section such that it may be substantially fully received in the fixed section when preparing the device for storage. Also, the foot-alignment bars are removably connectable to a fitting and may be disassembled from the fitting so that the alignment bars may be positioned adjacent to the fixed section and thereafter stored in a suitable container or bag. Then the device in the bag can easily be stored in the golf bag of the golfer. Cord that is either non-elastic or elastic may be provided to assist in keeping the foot-alignment bars associated with the fitting for reassembly. Thus, the device includes a minimum number of parts that can easily be manipulated for assembly, disassembly, and adjustment for use by a golfer. Wings or tabs are provided on the ball-positioning bar to facilitate engagement by the head of a club to swing the ball-positioning bar to the back of the golfer when swinging at the ball.

DESCRIPTION OF THE INVENTION

The golf setup training device of the present invention is T-shaped and generally designated by the numeral 15 when assembled and ready for use, as seen particularly in FIGS. 1 to 4, and includes a ball-positioning bar 16 and a pair of foot-alignment bars 19 and 20. As will be more particularly described below, the foot-alignment bars are employed for positioning the feet of a golfer or user, while the ball-positioning bar is employed for alignment of the body of the user along the foot-alignment bars, and to position the golf ball the proper distance from the feet of the user.

Figure 9:
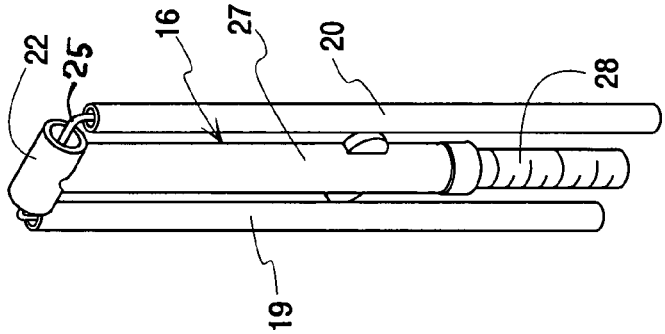
FIG. 9 is an elevational view of the device with the foot-alignment bars removed from the fitting on the ball-positioning bar and positioned along the ball-positioning bar to illustrate disassembly of the foot-positioning bars for storage purposes.
Figure 5:
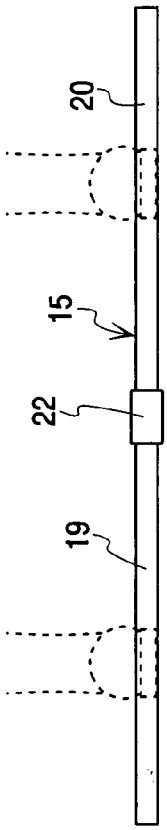
FIG. 5 is a rear elevational view of the training device of the invention and illustrating in phantom the feet of a golfer at the foot positioning bars.
Figure 6:
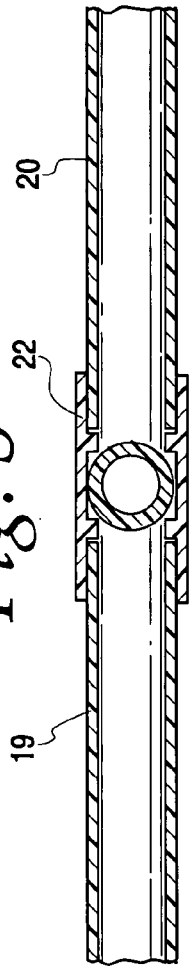
FIG. 6 is an enlarged cross-sectional view taken substantially along line 6-6 of FIG. 2.
Figure 7:
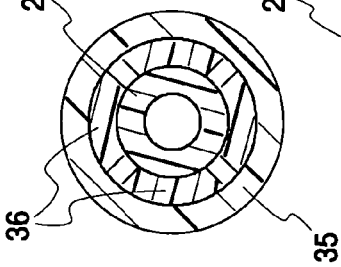
FIG. 7 is an enlarged cross-sectional view taken substantially along line 7-7 of FIG. 2.

The foot-alignment bars 19 and 20 may be tubular or solid and are suitably mounted in a fitting 22 positioned at one end of the ball-alignment bar. While any suitable means may be provided for mounting the foot-alignment bars in the fitting, they may be merely frictionally held in place and removable easily when storing of the device, as illustrated in FIG. 9. Preferably, the foot-alignment bars are each about twenty inches long but may be of any suitable length to provide a reference for placement of the feet of the golfer using the device. Optionally, the foot-alignment bars may be provided with an elastic or inelastic cord 25, as seen in FIG. 9, where the opposite ends are connected to each of the foot-alignment bars 19 and 20 and then threaded through the fitting, as seen in FIG. 9. The foot-alignment bars 19 and 20 are preferably tubular in structure and fit into circular openings on the fitting 22. However, it can be appreciated that the outer shape of the bars may be otherwise if desired.

The ball-positioning bar 16 includes a hollow fixed section 27 and an extendable section or extension 28. The extendable section 28 may be solid or tubular and is telescopically received by the fixed section. It is adjustable to the fixed section 27 for purposes of adjusting the length of the ball-positioning bar in accordance with the height of a golfer and/or the chosen club to be used for a setup exercise, as will be more clearly described below.

The fixed section 27 of the ball-positioning bar 16 is preferably tubular in form as is the extendable section 28. However, it can be appreciated that it may be made of other structural shapes so long as the extendable section is mounted to be adjustably carried by the fixed section.

Figure 10:
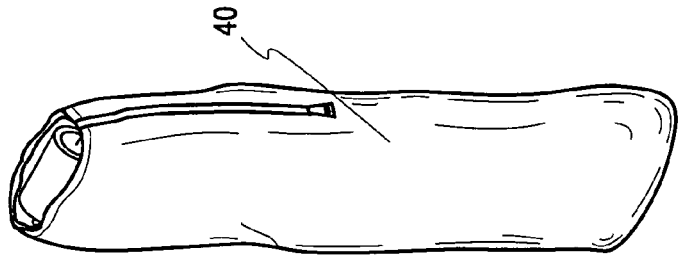
FIG. 10 is a perspective view of a bag into which the device is inserted for storage purposes.
Figure 8:
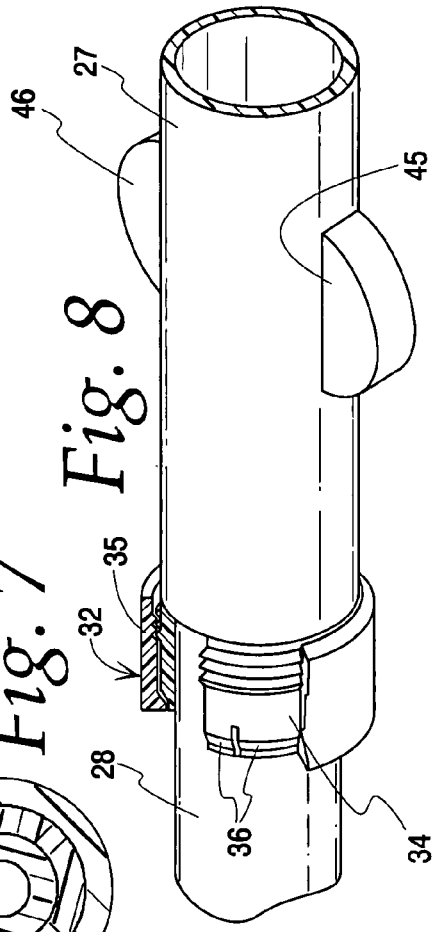
FIG. 8 is an enlarged fragmentary perspective view of the ball-positioning bar and showing the structure of the twist connector for locking the extendable section of the ball-positioning bar to the fixed section.

Moreover, as noted above, the extendable section 28 may be solid rather than tubular, if so desired. The extendable section 28, telescopically received within the fixed section 27, as particularly seen in FIG. 10, is selectively lockable to the fixed section by a twist connector 32 at a predetermined location for adjusting the total length of the ball-positioning bar. As seen in FIG. 8, the twist connector includes a threaded portion 34 on the fixed section 27 for receiving a threaded collar 35. The threaded section 34 includes fingers 36 that will tightly engage and grip the adjustable extendable section 28 upon twisting the collar 32 in the tightening direction to lock the extendable section to the fixed section. Similarly, by twisting the collar in the untightening direction, the fingers will release the grip on the extendable section 28 to allow it to be slidably positioned in the fixed section 27 to a desired location. As will be explained more particularly below, the ball-positioning bar 16 will be adjusted by the user according to the height of the user and the club chosen for determining ball placement. To adjust the ball-positioning bar it is only necessary to manipulate the twist connector 32 and slide the adjustable section 28 into or away from the fixed section 27 and thereafter manipulate the twist connector to lock the extendable section in position on the fixed section. It should be appreciated that any suitable twist connector may be used, or that a simple set screw system may be used for locking the extendable section at a predetermined position on the fixed section.

When preparing the device for storage, the foot-alignment bars 19 and 20 are removed from the fitting 22 and placed alongside the ball-positioning bar 16, as seen in FIG. 9. Further, the extendable section 28 of the ball-positioning bar is retracted into the fixed section 27 sufficiently to have the length of the ball-positioning bar substantially equal to the lengths of the foot-alignment bars, as seen in FIG. 9. Then the setup device is preferably inserted into a bag or package 40 which can then be stored in a golf bag, or wherever desired.

In operation, the golf setup training device 15 is first removed from the carrying bag 40 and then assembled by inserting the foot-alignment bars 19 and 20 into the fitting 22 that is integral with the fixed section 27 of the ball-positioning bar. These bars are sized to the openings in the fitting so as to frictionally interfit. Mounting of the foot-alignment bars to the ball-positioning bar disposes the foot-alignment bars at right angles to the ball-positioning bar. The golfer next adjusts the length of the ball-positioning bar in accordance with the golfer's height by manipulating the position of the extendable section 28 relative to the fixed section 27. The following chart is provided with the device to guide the golfer in properly adjusting the ball-positioning bar to the proper length.

| Golfer Height (feet & inches) | Ball Positioning Bar Length (Inches) |
|---|---|
| 5'4" | 23½ |
| 5'5" | 23 |
| 5'6" | 22½ |
| 5'7" | 22 |
| 5'8" | 21½ |
| 5'9" | 21 |
| 5'10" | 20½ |
| 5'11" | 20 |
| 6' | 19½ |
| 6'1" | 19 |
| 6'2" | 18½ |
| 6'3" | 18 |
| 6'4" | 17½ |
| 6'5" | 17 |
| 6'6" | 16½ |
| 6'7" | 16 |

Figure 1:
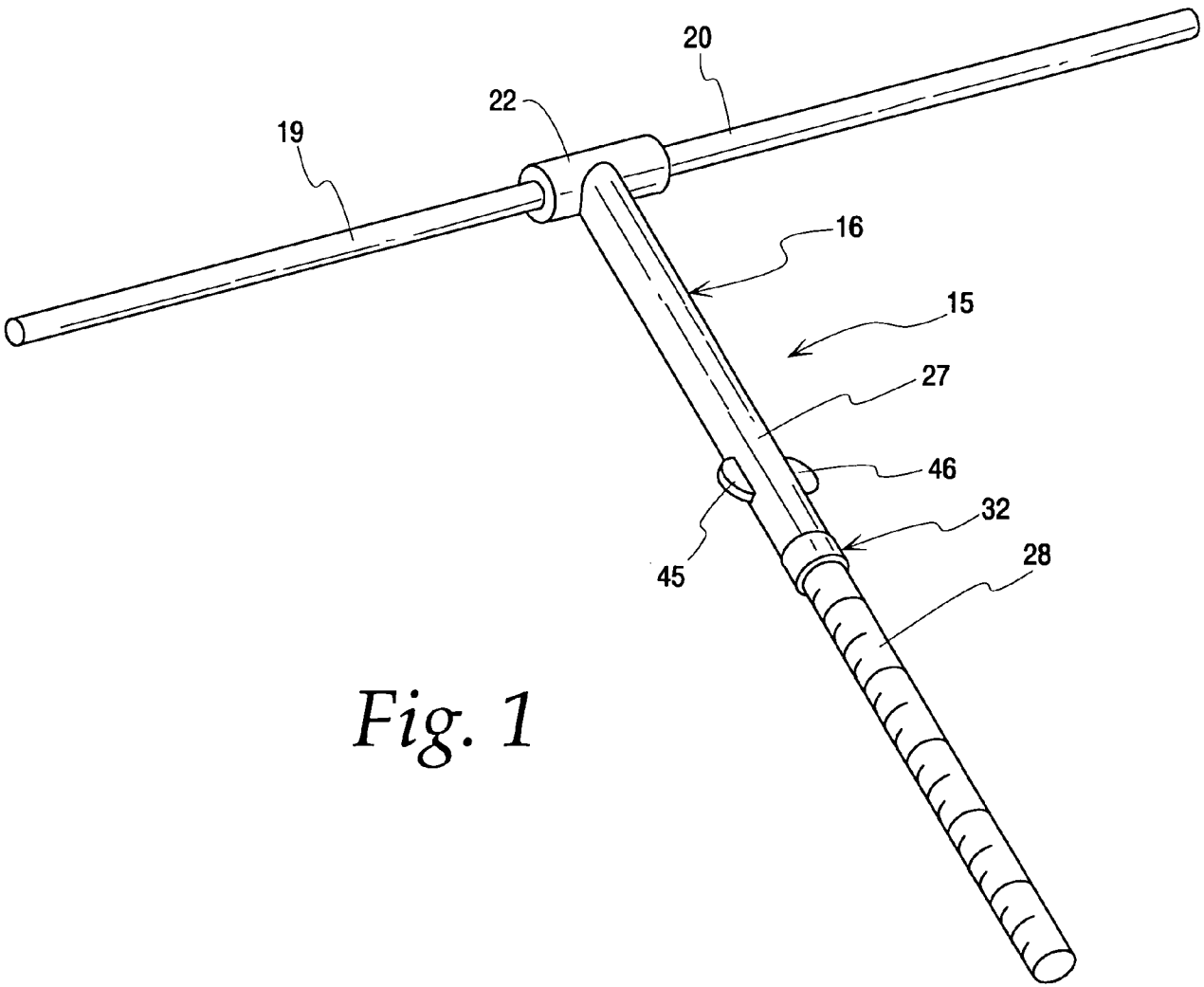
FIG. 1 is a perspective view of the golf setup training device of the invention.

The extendable or adjustable section 28 of the ball-positioning bar will include incremental inch graduations, as illustrated in FIG. 1. Further, it will be understood that numerical inch indicia will be applied to the extendable section to facilitate adjustment. The length of the ball-positioning bar according to a particular height is measured from the center of the fitting 22 to the outer free end of the extendable section 28. For example, a golfer five feet seven inches tall will adjust the position of the extendable section such that the dimension from the fitting to the tip end of the extendable section is 22 inches for taking a stance with a 6 iron. It will be appreciated that the 6 iron is the standard, and that when taking a stance with a higher or lower iron, the position of the extendable bar will be adjusted accordingly. It will also be appreciated that when adjusting the position of the extendable bar relative to the fixed bar, the fixed connector 32 will be untightened to allow sliding movement of the extendable section in the fixed section and then tightened to lock the extendable section to the fixed section in establishing the total length of the ball-positioning bar as desired.

The distance from the center of the fitting to the end of the fixed section of the ball-positioning bar is 13½ inches. So, for a golfer five feet seven inches in height, the extendable section would be set to add another 8½ inches to total 22 inches. With respect to numerical indicia on the extendable section, markings from 16 to 23½ inches will cover the adjustments identified in the above chart. The incremental graduations would include inch, one-half inch, and one-quarter inch markings, although the one-quarter inch markings would only be used for adjusting to set the bar for wedges.

When using the device for a setup with other irons, the extendable section is adjusted to make the ball-positioning bar longer for the lower number irons and shorter for the higher number irons. When adjusting for clubbing down from the 6 iron to the 9 iron, the extendable section is moved into the fixed section one-half inch per club. Thereafter, when clubbing down to the pitching wedge, sand wedge and lob wedge, the extendable section is moved one-quarter inch inward per club from the set point for the height of the golfer. When adjusting the device to club up from the 6 iron to the 2 iron, the extendable section is extended from the fixed section one-half inch per club from the set point for the height of the golfer.

Another guide for adjusting the position of the extendable section relative to the fixed section for using different irons is illustrated by the following chart:

2 iron: +2"
3 iron: +1½"
4 iron: +1"
5 iron: +½"
6 iron: standard
7 iron: −½"
8 iron: −1"
9 iron: −1½"
PW: −1¾" (48-52 degrees)
SW: −2" (54-56 degrees)
LW: −2¼" (58-60 degrees)

With respect to the above chart, it will be seen that from the standard position for a particular height the 6 iron is usable in the initial setup. Since the irons are of different lengths, the length of the ball-positioning bar will be adjusted when going to a lower or higher lofted club. Going from the 6 iron to the 2 iron, the extendable section is extended one-half inch per club. Going from the 6 iron to the 9 iron, the extendable section is shortened one-half inch per club, and from the 9 iron to the lob wedge, the extendable section is shortened one-quarter inch per club.

Figure 2:
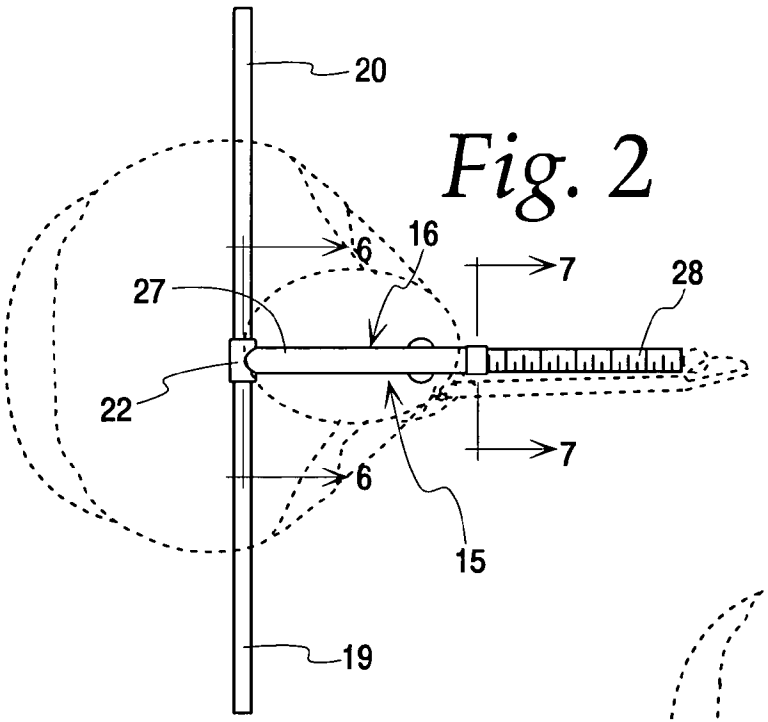
FIG. 2 is a top plan view of the device and showing in phantom the position of a golfer with a golf club and where the extendable section of the ball-positioning bar is at a predetermined position.
Figure 3:
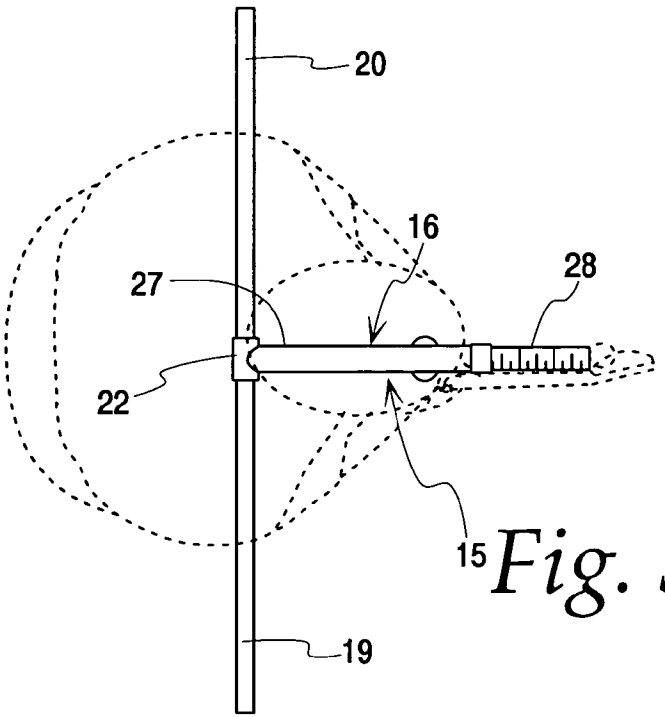
FIG. 3 is a view similar to FIG. 2, to illustrate the adjustability of the extendable section of the ball-positioning bar when adjusted for a golfer of a different height.
Figure 4A:
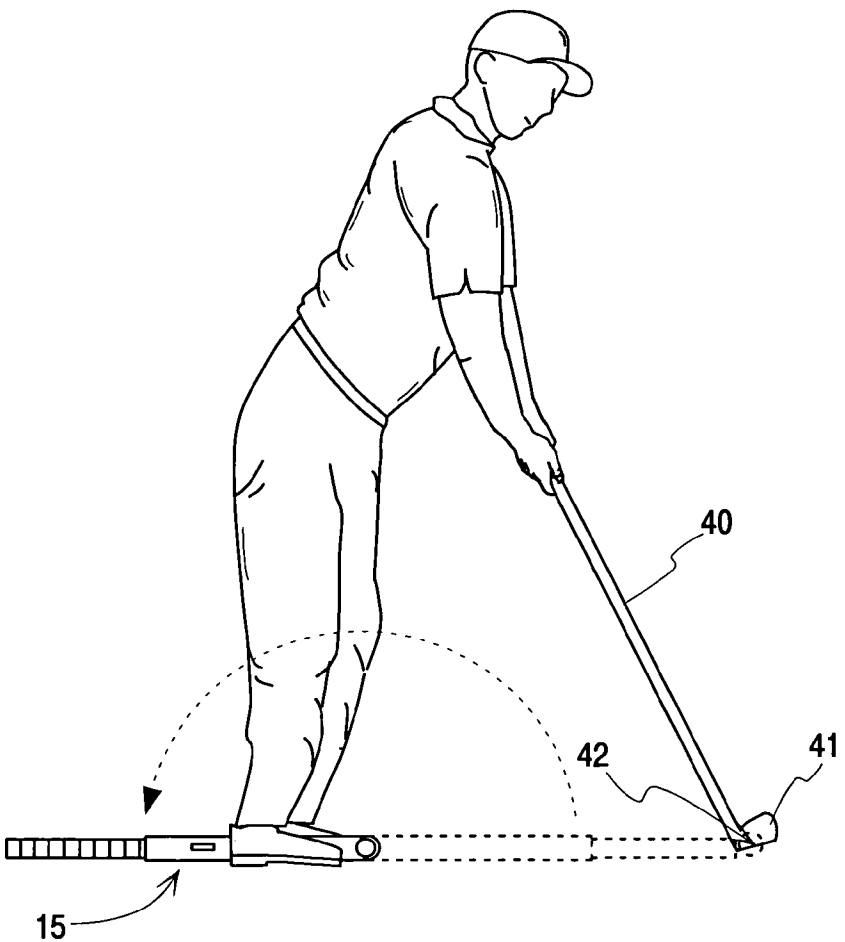
FIG. 4*a* is an end elevational view of the device for the golfer where the ball-positioning bar has been flipped from the sight of the golfer to a position behind the golfer.
Figure 4:
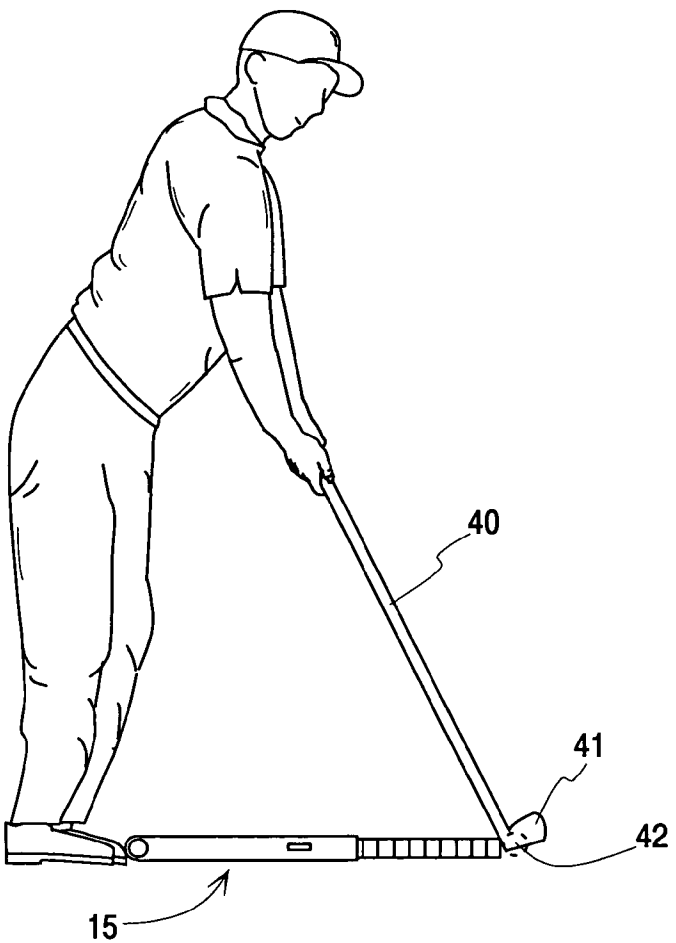
FIG. 4 is an end elevational view of the training device resting on the ground and a depiction of a golfer in a stance with a club positioned to strike a ball.

When the golfer has properly adjusted the device for the golfer's height and for use of a particular club, the device is placed on the ground and the golfer is positioned so that the golfer's feet are behind and in alignment with the foot-alignment bars, and the body of the golfer is centrally positioned relative to the ball-positioning bar for a 6 iron, as seen in FIGS. 2-4. In this position, the ball-positioning bar extends out away from the end in front of the golfer. The ball is then placed at the tip end of the ball-positioning bar, as seen in FIGS. 2-4. The golfer's setup is established by posturing the golfer's body with the club, as shown by the club 40, so that the head 41 of the club is aligned with the ball 42. Thus, the setup is established for a given club and a given height of the golfer. Further, adjustment of this setup is made for the golfer in accordance with the club chosen for the stance, as in the above chart.

Once the setup is established, the golfer may then use the head of the club to engage one of the wings 45 or 46, depending on whether the golfer is right-handed or left-handed, to raise the ball positioning bar and swing it between the legs of the golfer and to a position behind the golfer, as shown in FIG. 4*a*. This removes the ball-positioning bar from the front of the golfer to remove any possible distraction during swinging of the club to strike the ball. This also trains the golfer to take the proper setup without reliance on the setup device when engaged in the playing on a golf course.

It will be appreciated that the setup training device 15 can easily be used for a left-handed or right-handed golfer without otherwise considering a need to change or adjust the training device. Moreover, with respect to establishing a setup for an iron other than a 6 iron, in addition to adjusting the overall length of the ball-positioning bar, a golfer can shift position along the feet-alignment bars to establish a setup for a different iron. Normally, a golfer would shift position such that the center of the golfer's body would be adjusted to the right of the ball-positioning bar for longer irons and to the left of the ball-positioning bar for shorter irons.

It is most significant that the setup training device of the present invention is particularly useful in order to teach a proper setup for the use of irons such that the feet of the golfer will be positioned at the proper distance from the ball when the swing is made to strike the ball.

It will be understood that modifications and variations may be effected without departing from the scope of the novel concepts of the present invention, but it is understood that this application is to be limited only by the scope of the appended claims.

The invention claimed is:

1. A golf setup training device for a user to determine the proper setup for irons comprising:

a pair of oppositely extending axially aligned rigid round tubular foot-alignment bars removably connected to a fitting against which the toes of a user's feet would be positioned, a rigid round tubular ball-positioning bar extending intermediate of and at right angles to the foot-alignment bars serving as a reference along which the center of the user's body would be substantially aligned or offset therefrom, said ball-positioning bar having a fixed section connected to the foot-alignment bars, and a rigid round tubular extendable section telescopically received by the fixed section and having a ball placement tip end at which a ball would be positioned for establishing the proper setup, said fixed and extendable sections sized such that the extendable section can be received within the fixed section when storing the device, incremental graduations on said extendable section coacting with the length of the fixed section for setting the position of the extendable section according to the height of the user and the club to be used, and locking means coacting with said fixed section and said extendable section for adjustably retaining the extendable section at a predetermined position on the fixed section, whereby the user would place the toes of his/her feet along and aligned with the foot-alignment bars with the center of his/her body substantially aligned with the ball-positioning bar, place the ball at the tip end of the bar, and manipulate the club head of a given iron gripped by the user in alignment with the ball thereby defining the substantially ideal setup for the user and thereafter flipping the ball-positioning bar to the rear of the user prior to hitting the ball.

2. The training device of claim 1, wherein said fitting removably receives the tubular foot-alignment bars for facilitating disassembly of the bars from the fitting for compact storage of said device.

3. The training device of claim 2, which further comprises means loosely connecting the foot-alignment bars to the fitting.

4. The training device of claim 3, wherein said means includes flexible means connected to the foot-alignment bars and the fitting.

5. The training device of claim 3, wherein said means includes a flexible line extending through the fitting and being connected to said foot-alignment bars.

6. The training device of claim 1, wherein said locking means is a twist connector.

7. The training device of claim 1, wherein the length of the fixed section is 13½ inches and the extendable section is extendable 11½ inches and incrementally marked to adjust for a person between 5 feet 4 inches to 6 feet 7 inches in height.

8. The training device of claim 1, which further comprises means on said ball-positioning bar engageable by a club head for swinging the ball positioning bar upward and between the legs of the user to place the ball positioning bar behind the user when the user swings at the ball without changing the user's setup.

9. The training device of claim 8, wherein said engageable means includes wing members extending from the fixed section of the ball positioning bar and intermediate the ends thereof.

10. A method of establishing the proper ball setup for a golfer using a setup training device for irons having a pair of axially aligned rigid round tubular foot-alignment bars and a rigid round tubular extendable ball positioning bar having a free end connected perpendicularly to said foot-alignment bars, said method comprising the steps of:

adjusting the length of the extendable ball-positioning bar according to the height of the golfer and the club to be used, placing the device on the ground, aligning the toes of the feet of the golfer substantially against the foot-alignment bars so the golfer faces the ball-positioning bar with the center of the golfer being substantially aligned with or offset from the ball-positioning bar depending on the club to be used, positioning a ball at the free end of the ball-positioning bar, gripping a club, taking a position with the club so that its head is positioned directly behind the ball, and swinging the ball-positioning bar up and to the back of the golfer before executing a swing.

11. The method of claim 10, which includes the further step of adjusting the ball-positioning bar length for clubs of different lengths and repositioning the golfer relative to the ball-positioning bar.

* * * * *